US006260328B1

(12) United States Patent
Fowler et al.

(10) Patent No.: US 6,260,328 B1
(45) Date of Patent: Jul. 17, 2001

(54) VINYL LUMBER SLEEVES AND CAPS

(76) Inventors: John Harrison Fowler, 1405 NC. Hwy. 1775, Rockingham, NC (US) 28379; Beatrice Gaddy, 140 N. Collington Ave., Baltimore, MD (US) 21231

( * ) Notice: Subject to any disclaimer, the term of this patent is extended or adjusted under 35 U.S.C. 154(b) by 0 days.

(21) Appl. No.: 09/290,486

(22) Filed: Apr. 12, 1999

(51) Int. Cl.[7] ..... B65D 43/08

(52) U.S. Cl. ..... 52/732.1; 52/309.15; 52/313; 52/738.1; 52/DIG. 7; 220/796

(58) Field of Search ..... 52/170, 169.14, 52/309.15, 313, 515, 732.1, 738.1, DIG. 7, 177; 220/604, 625, 796

(56) References Cited

U.S. PATENT DOCUMENTS 2,724,156 * 11/1955 Shaw ..... 52/170 X
3,133,663 * 5/1964 Schurman et al. ..... 220/796
3,143,239 * 8/1964 Wiley et al. ..... 2220/796
3,259,298 * 7/1966 Gorton ..... 2220/796
4,885,882 * 12/1989 Forshee ..... 52/177
4,907,387 * 3/1990 Turnbull ..... 52/177
5,315,796 * 5/1994 Gruhlke ..... 52/170
5,326,187 * 7/1994 St. Marie et al. ..... 52/738.1 X
5,794,390 * 8/1998 Oliveri et al. ..... 52/738.1 X

* cited by examiner

*Primary Examiner*—Carl D. Friedman
*Assistant Examiner*—Kevin D. Wilkens

(57) ABSTRACT

A wood protection assembly including a plastic sleeve having an open end and closed end, and the sleeve being dimensioned to conform closely to and to receive a wooden structural member of standard dimensions, and a plastic cap formed to slip over and tightly seal the open end of the sleeve. Upon the insertion of the wooden structural member in the open end of the sleeve and the sealing of the open end of the sleeve with the cap, the wooden structural member is completely enclosed by the assembly and the wooden structural member and the assembly are such close relation that the wooden structural member is immobilized within the assembly, whereby the assembly protects the wooden structural member from the elements without compromising the rigid integrity of the wooden structural member.

13 Claims, 4 Drawing Sheets

VINYL LUMBER SLEEVES AND CAPS

BACKGROUND OF THE INVENTION

The invention relates to the construction field, particularly to outdoor projects and building components made with wood. Individual wooden structural members of all types and sizes as well as a variety of sheet-type woods and wood products are commonly used to build outdoor projects. These projects may include decks, fencing exterior house trim, stairs and many other items.

The wood in these projects or items is constantly subjected to rain, temperature fluctuations, ultraviolet rays from the sun, airborne fungus and insect infestation. These elements are known to deteriorate the wood. Another major problem that occurs with outdoor wood structures is fading. The sun and the elements of the weather will fade lumber to an unattractive grayish color. A multi-billion dollar industry in sealers, stains, protectorates, preservatives has spawned to help combat all of the above forces with little short-term success and no long-term success. To help prevent these problems, each wooden structural member, such wooden structural members also referred to herein as "lumber", may be inserted into a plastic sleeve and matching plastic cap according to the present invention to protect the wood from the above-mentioned forces. For example, these sleeves and caps provide the encased lumber with excellent protection from airborne fungus that traditionally infest outdoor wood. If fungus appears on the sleeves and caps, it only needs to be hosed off In general, the protection provided to lumber by the present invention from the ultraviolet rays of the sun, rain and moisture, mildew and fungus, and insect infestation allows projects built using the present invention to have long life with very little maintenance and upkeep.

Another problem in the construction industry deals with the need to protect wood used for trim on outdoors structures. To protect these wood trim members from the harmful elements mentioned earlier, contractors have to wrap aluminum around all of the exposed trim surfaces and edges. Not only is this time consuming, it also requires the use of a large metal-bending machine that has to be transported to the job site. In addition, the wrapping of the wood surfaces is usually done by sub-contracted crews at considerable expense. As described further below, the sleeves and caps described herein are much simpler and more efficient to use than these costly, time-consuming wood protection measures. Therefore, the invention reduces the time and expense associated with constructing wooden structures.

SUMMARY OF THE INVENTION

Therefore, it is an object of the invention to provide a wood protection assembly that allows for long-term deterioration protection of wood that is subjected to such damaging forces as the ultraviolet rays of the Sun, rain and moisture, mildew and fungus, and insect infestation.

It is another object of the invention to provide a wood protection assembly that is available in an assortment of colors for enabling color coordination with existing structures.

It is another object of the invention to provide a wood protection assembly that drastically reduces the time and expense associated with protecting wood trim members of the outside of structures.

It is another object of the invention to provide a wood protection assembly that is low-maintenance wood protection alternative that does not require the use of cleaners, preservatives, sealers and other agents to maintain its appearance and longevity. It is another objective of the invention to provide a wood protection assembly having sleeves and caps with woodgrain markings etched thereon to enhance their appearance. It is another object of the invention to provide a wood protection assembly having sleeves and caps in a wide variety of sizes to accommodate a range of construction needs.

These and other objects of the present invention are achieved in the preferred embodiments disclosed below by providing a wood protection assembly including a plastic sleeve having an open end and a closed end, and the sleeve being dimensioned to conform closely to and to receive a wooden structural member of standard dimensions, and a plastic cap formed to slip over and tightly seal the open end of the sleeve. According to one preferred embodiment of the invention, the main body of the plastic sleeve has a constant cross section along it's entire length from the closed end (bottom), to the open end, (top). Upon the insertion of the wooden structural member in the open end of the sleeve and the sealing of the open end of the sleeve with the cap, the wooden structural member is completely enclosed by the assembly and the wooden structural member and the assembly are in such close relation that the wooden structural member is immobilized within the assembly, whereby the assembly protects the wooden structural member from the elements without compromising the rigid integrity of the wooden structural member.

According to another preferred embodiment of the invention, the wooden structural member is elongate with rectangular or square ends.

According to another preferred embodiment of the invention, the wooden structural member is a plywood sheet.

According to yet another preferred embodiment of the invention, woodgrain markings are etched into the sleeve and the cap. According to yet another preferred embodiment of the invention, the sleeve and the cap each have a thickness of from 1/32 inch to 1/16 inch.

According to one preferred embodiment of the invention, a wood protection assembly provided, the assembly including a polyvinyl sleeve having an open end and closed end, said sleeve being dimensioned to conform closely to and to receive a wooden structural member of standard dimensions, and a polyvinyl cap formed to slip over and tightly seal the open end of the sleeve. Upon the insertion of the wooden structural member in the open end of the sleeve and the sealing of the open end of the sleeve with the cap, the wooden structural member is completely enclosed by the assembly and the wooden structural member and the assembly are in such close relation that the wooden structural member is immobilized within the assembly, and wherein woodgrain markings are etched on the sleeve and the cap, whereby the assembly protects the wooden structural member from the elements without compromising the rigid integrity of the wooden structural member.

According to one preferred embodiment of the invention, a wood protection assembly is provided, the assembly including a polyvinyl sleeve having an open end and a closed end, said sleeve being dimensioned to conform closely to and to receive a wooden structural member of standard dimensions, and a polyvinyl cap formed to slip over and tightly seal the open end of the sleeve. Upon the insertion of the wooden structural member in the open end of the sleeve and the sealing of the open end of the sleeve with the cap, the wooden structural member is completely enclosed by the assembly and the wooden structural member and the assembly are in such close relation that the wooden structural member is immobilized within the assembly, and wherein woodgrain markings are etched on the sleeve and the cap, and the sleeve and the cap each have a thickness of from 1/32 inch to 1/16 inch, whereby the assembly protects the wooden structural member from the elements without compromising the rigid integrity of the structural member.

BRIEF DESCRIPTION OF THE DRAWINGS

Some of the objects of the invention have been set forth above. Other objects and advantages will appear as the description proceeds when taken in conjunction with the following drawings, in which.

DETAILED DESCRIPTION OF THE PREFERRED EMBODIMENT AND BEST MODE

Figures 1A, 1B:
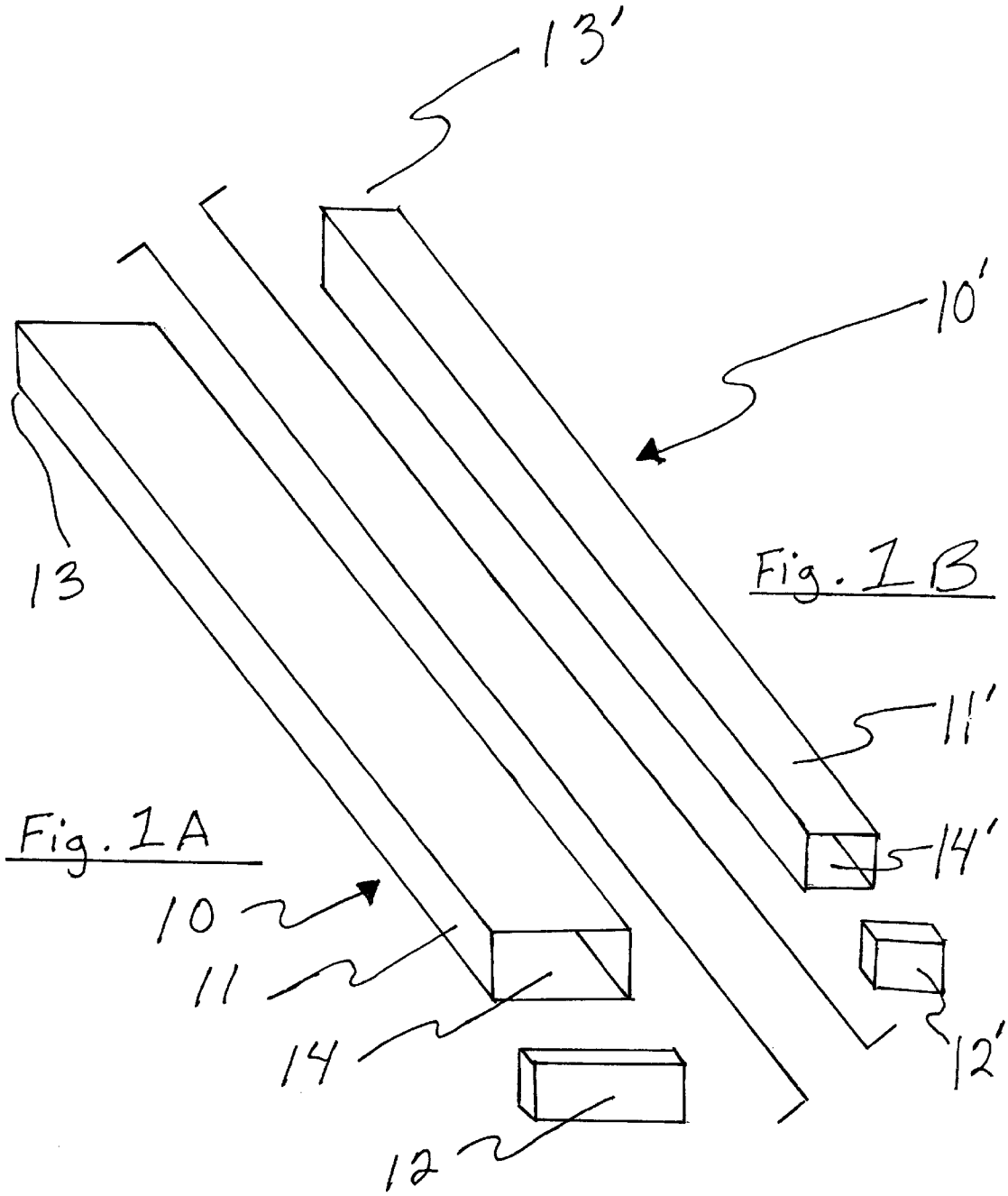
FIG. 1A is an exploded view of a sleeve and matching cap according to a preferred embodiment of the invention dimensioned to fit over an elongate wooden structure member with a rectangular end.
FIG. 1B is an exploded view of a sleeve and matching cap according to a preferred embodiment of the invention dimensioned to fit over and elongate wooden structural member with a square end.

Referring now specifically to the drawings, a wood protection assembly according to the present invention is illustrated in FIG. 1A and shown generally at reference numeral 10. In specific, the assembly 10 comprises a sleeve 11 and matching cap 12, both comprised of a plastic such as, in a preferred embodiment of the invention, polyvinyl. The sleeve 11 includes a closed end 13 and an open end 14. Again, looking at the sleeve 11, the main body has a constant cross section along it's entire length from the bottom (closed end-13) to the top (open end-14). The open end 14 is properly dimension to receive wooden structural members of standard dimensions such that the sleeve 11 closely conforms to the contours of the wooden structural member being inserted. The cap 12 is dimensioned to closely slip over and seal the open end 14 of the sleeve 11 such that the entire inserted wooden structural member is covered by and immobilized in the assembly 10.

Figure 4:
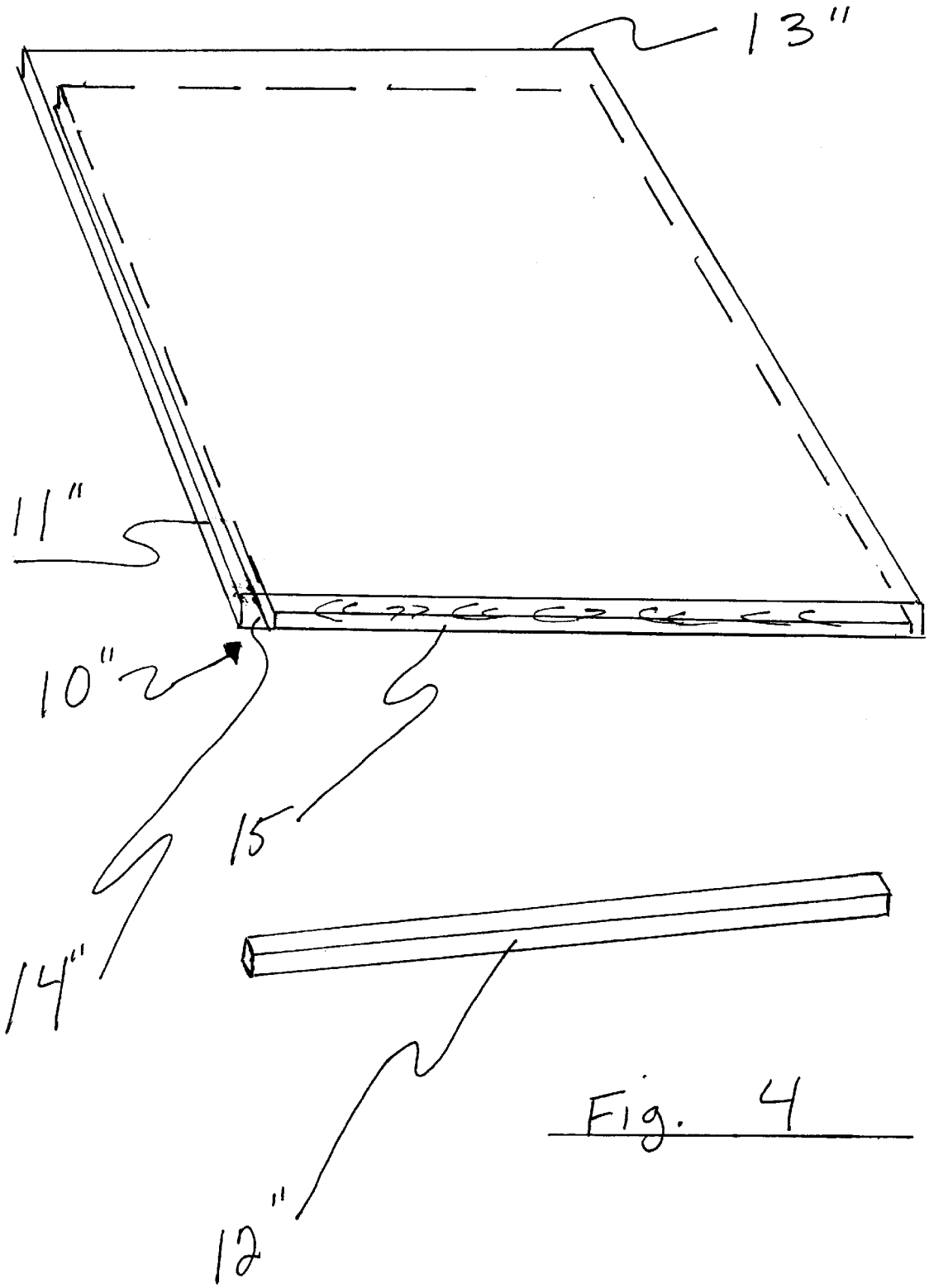
FIG. 4 is a perspective view of a sheet of plywood inserted into a sleeve with a matching cap according to a preferred embodiment of the invention, with the covered portion of the plywood sheet shown in dotted lines.

As mentioned briefly above, the assembly 10 may be used to protect wooden structural members of various standard dimensions. For example, as shown in FIG. 1A, the sleeve 11 and cap 12 are formed to fit an elongate wooden structural member (not shown) with a rectangular end, such as a 2" by 4" wooden plank of a predetermined length. FIG. 1B shows a preferred embodiment of the assembly 10' formed to fit an elongate wooden structural member (not shown) with a square end such as a 2" by 2" wooden post of a predetermined length. The sleeve shown at reference numeral 11' has a main body with a constant cross section along it's entire length from the bottom (closed end 13') to the top (open end 14'). The open end 14' is properly dimensioned to receive wooden structural members of standard dimensions such that sleeve 11' closely conforms to the contours of the wooden structural member being inserted. The cap 12' is dimensioned to closely slip over and seal the open end 14' of the sleeve 11' such that the entire inserted wooden structural member (not shown) is covered by and immobilized by the assembly 10'. FIG. 4 shows yet another preferred embodiment of the invention 10", this one being formed to fit a plywood sheet 15 of predetermined, standard dimensions.

Figure 2:
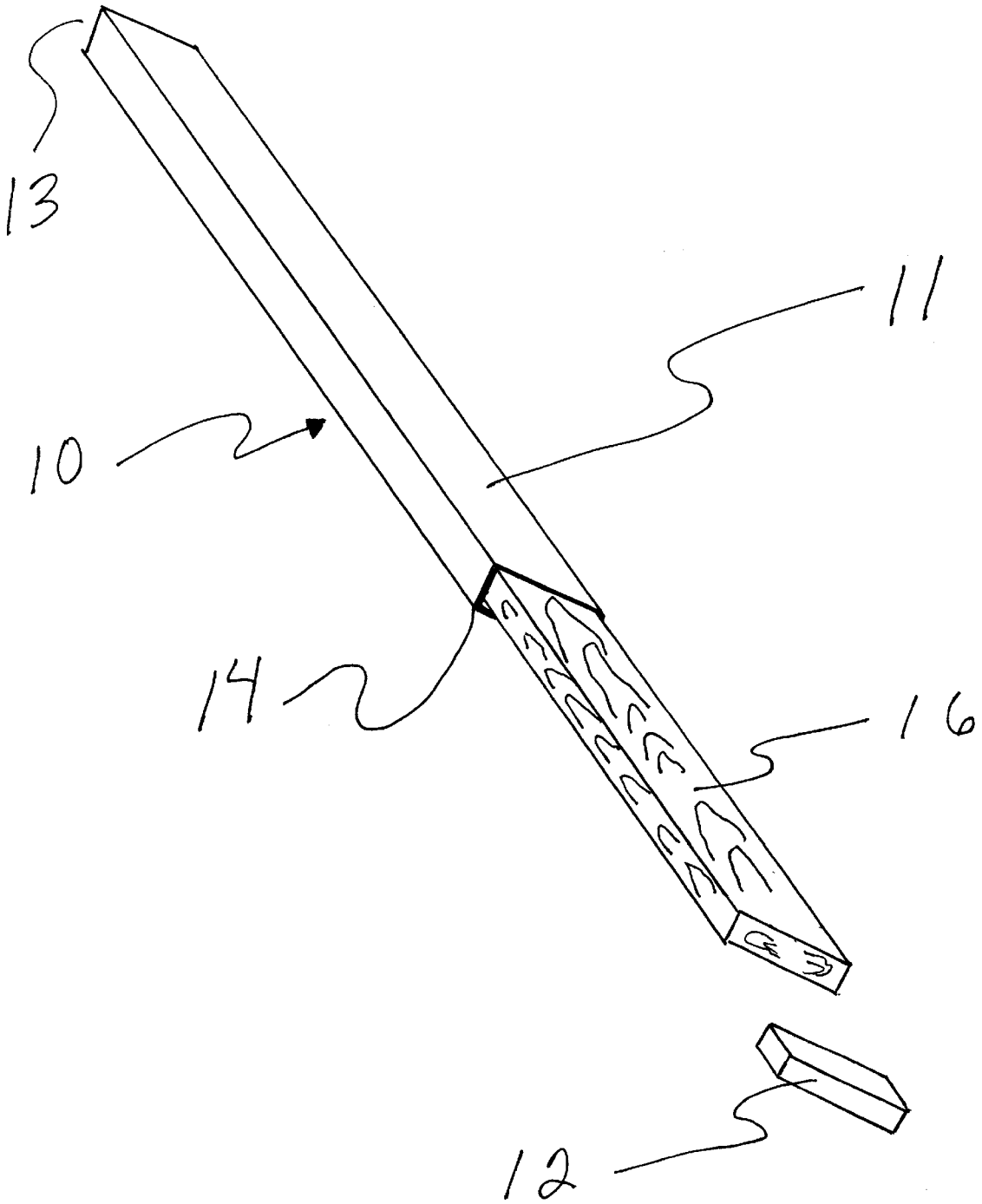
FIG. 2 is a perspective view of lumber being inserted into a sleeve according to a preferred embodiment of the invention, with a matching cap also shown.

FIGS. 2 and 4 show methods of using preferred embodiments of the invention. FIG. 2 illustrates an elongate wooden structural member with a rectangular end 16 partially inserted into the assembly 10, while FIG. 4 shows the plywood sheet 15 partially inserted into the assembly 10". In general, looking again at FIG. 4, to use the invention, a wooden structural member such as the plywood sheet 15 is inserted entirely into the sleeve 11;", the cap 12" is then slipped over the open end 14" of the sleeve 11" such that the open end 14" of the sleeve 11" is tightly sealed. The cap 12" is then secured to the sleeve 11" and/or the plywood sheet 15 by, for example, hammering a nail or other fastener (not shown) through the cap 12", and optionally, through the sleeve 11", into the plywood sheet 15.

Figure 3:
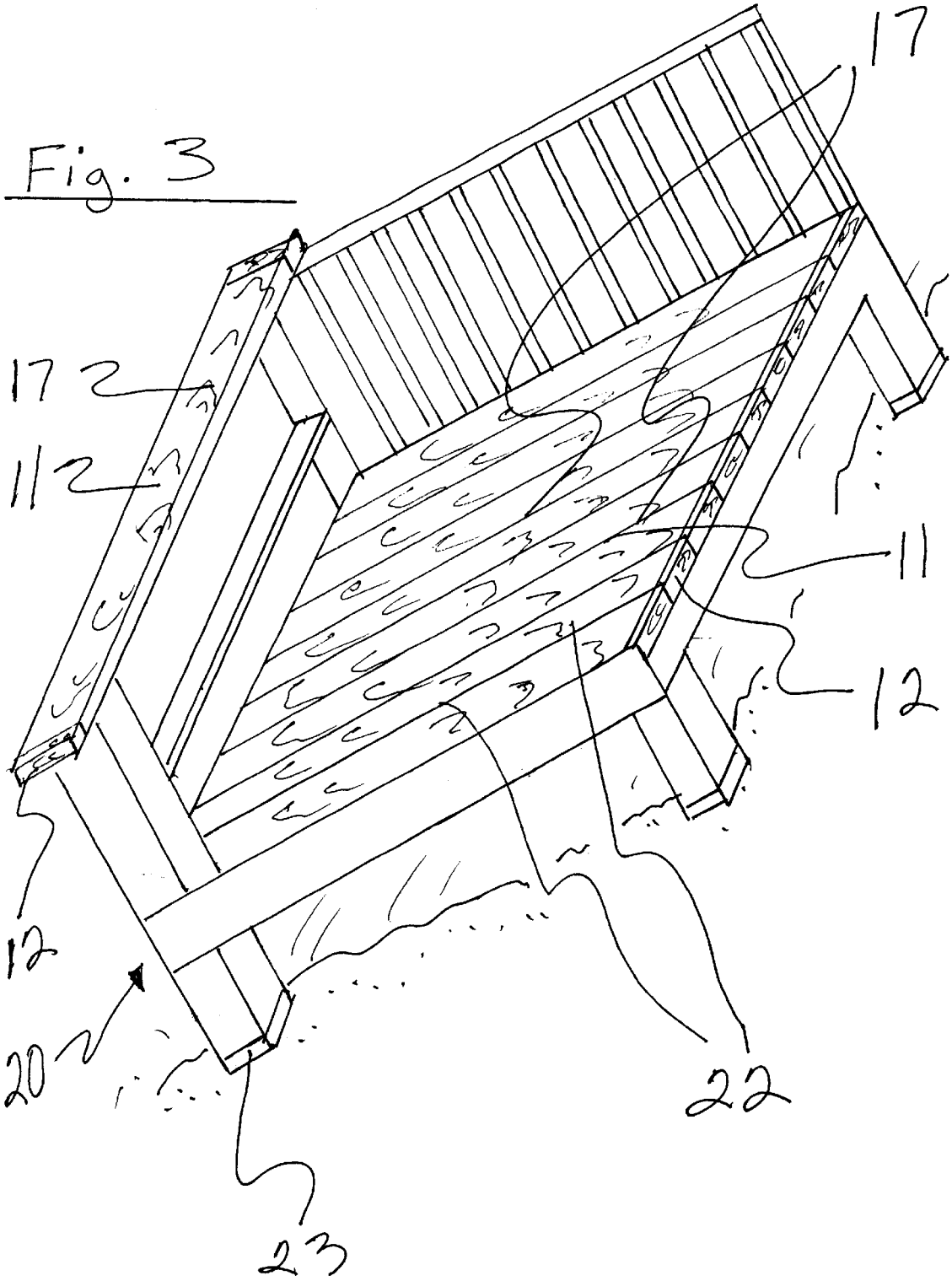
FIG. 3 is a perspective view of a deck constructed entirely of lumber encased in sleeves and caps according to a preferred embodiment of the invention.

As shown in FIGS. 1A, 1B, and 10", at reference numerals 11, 11", and 11" respectively, the main body of the sleeve has a constant cross section along it's entire length from the bottom (closed end 13, 13' and 13"), to the top (open end 14, 14' and 14"). Wooden structural members protected by the present invention may be utilized in construction as desired. For example, as shown in FIG. 3, protected wooden structural members 17 may be used to construct a deck 20. Anti-slip treads may be added to the vinyl lumber sleeves 11 and caps 12 by the consumer to help ensure the safety of people walking on structures constructed using wooden structural members protected by the present invention. The sleeves 11 and caps 12 may also be etched with woodgrain markings 22 to enhance their aesthetics. FIG. 3 also shows how the invention may be used to protect an underground portion 23 of a wooden structural member. The sleeves and matching caps of the present invention may be manufactured in a variety of standard dimensions, as needed including but not limited to heights and widths of 1", 1¼", 2", 4", or 6", and lengths including but not limited to 6 to 24 feet. In any event, the thickness of the polyvinyl sleeves and caps will be 1/32 inch to 1/16 inch, with and approximate gauge of 0.040. The thickness will be consistent throughout the entire body of the assembly, including the bottom. The sleeves and caps may be manufactured using extrusion or molding processes. To allow aesthetic flexibility, the sleeves and caps of the present invention may be manufactured using any available color of polyvinyl. A wood protection assembly comprising vinyl lumber sleeves and caps is described above. Various details of the invention may be changed without departing from its scope. Furthermore, the foregoing description of the preferred embodiment of the invention and the best mode for practicing the invention are provided for the purpose of illustration only and not for the purpose of limitation—the invention being defined by the claims.

What is claimed is:

1. A wood protection assembly, comprising:

(a) a plastic sleeve having an open end, a closed end, and a constant cross section along its entire length from the open end to the closed end, and said sleeve being dimensioned to conform closely to and to receive a wooden structural member of standard dimensions; and (b) a plastic cap formed to slip over and tightly seal the open end of the sleeve; wherein upon the insertion of the wooden structural member in the open end of the sleeve and the sealing of the open end of the sleeve with the cap, the wooden structural member is completely enclosed by the assembly and the wooden structural member and the assembly are in such close relation that the wooden structural member is immobilized within the assembly, whereby the assembly protects the wooden structural member from the elements without compromising the rigid integrity of the wooden structural member.

2. A wood protection assembly according to claim 1, wherein said plastic sleeve and plastic cap are comprised of polyvinyl.

3. A wood protection assembly according to claim 1, wherein said wooden structural member is elongate with rectangular or square ends.

4. A wood protection assembly according to claim 1, wherein said wooden structural member is a plywood sheet.

5. A wood protection assembly according to claim 1, wherein woodgrain markings are etched into said sleeve and said cap.

6. A wood protection assembly according to claim 1, wherein the thickness of the sleeve and the cap is from 1/32 inch to 1/16 inch.

7. A wood protection assembly according to claim 1, wherein the thickness of the plastic sleeve is consistent throughout the main body including the closed end.

8. A wood protection assembly, comprising;

(a) a polyvinyl sleeve having an open end, a closed end, and a constant cross section along its entire length from the open end to the closed end, and said sleeve being dimensioned to conform closely to and to receive a wooden structural member of standard dimensions; and (b) a polyvinyl cap formed to slip over and tightly seal the open end of the sleeve; wherein upon the insertion of the wooden structural member in the open end of the sleeve and the sealing of the open end of the sleeve with the cap, the wooden structural member is completely enclosed by the assembly and the wooden structural member and the assembly are in such close relation that the wooden structural member is immobilized within the assembly, and wherein woodgrain markings are etched on the sleeve whereby the assembly protects the wooden structural member from the elements without compromising the rigid integrity of the wooden structural member.

9. A wood protection assembly according to claim 8, wherein said wooden structural member is elongate with rectangular or square ends.

10. A wood protection assembly according to claim 8, wherein said wooden structural member is a plywood sheet.

11. A wood protection assembly, comprising:

(a) a polyvinyl sleeve having an open end, a closed end, and a main body, and said sleeve being dimensioned to conform closely to and to receive a wooden structural member of standard dimensions; and (b) a polyvinyl cap formed to slip over and tightly seal the open end of the sleeve; wherein upon the insertion of the wooden structural member in the open end of the sleeve and the sealing of the open end of the sleeve with the cap, the wooden structural member is completely enclosed by the assembly and the wooden structural member and the assembly are in such close relation that the wooden structural member is immobilized within the assembly, and wherein woodgrain markings are etched on the sleeve and the sleeve and the cap each have a thickness of from 1/32 inch to 1/16 inch, whereby the assembly protects the wooden structural member from the elements without compromising the rigid integrity of the wooden structural member and wherein the polyvinyl sleeve has a constant cross section along its entire length from the closed end to the open end.

12. A wood protection assembly according to claim 11, wherein said wooden structural member is elongate with rectangular or square ends.

13. A wood protection assembly according to claim 11, wherein said wooden structural member is a plywood sheet.

* * * * *